US009246289B2

(12) United States Patent
Riedmaier et al.

(10) Patent No.: US 9,246,289 B2
(45) Date of Patent: Jan. 26, 2016

(54) SLIDING CONTACT ARRANGEMENT FOR TRANSMITTING ELECTRICAL SIGNALS AND ALSO A METHOD FOR PRODUCING THE SLIDING CONTACT ARRANGEMENT

(71) Applicant: Spinner GmbH, Westerham (DE)

(72) Inventors: Martin Riedmaier, Ebersberg (DE); Johannes Kriwanek, Bruckmuehl (DE); Martin Holzmair, Bad Aibling (DE); Wolfgang Zissler, Feldkrichen-Westerham (DE)

(73) Assignee: SPINNER GMBH, Westerham (DE)

( * ) Notice: Subject to any disclaimer, the term of this patent is extended or adjusted under 35 U.S.C. 154(b) by 32 days.

(21) Appl. No.: 14/291,044

(22) Filed: May 30, 2014

(65) Prior Publication Data

US 2015/0349477 A1 Dec. 3, 2015

(51) Int. Cl.

| | |
|---|---|
| ***H01R 39/00*** | (2006.01) |
| ***H01R 39/64*** | (2006.01) |
| ***H01R 43/10*** | (2006.01) |
| ***H01R 39/26*** | (2006.01) |

(52) U.S. Cl.

CPC ..... *H01R 39/64* (2013.01); *H01R 39/26* (2013.01); *H01R 43/10* (2013.01)

(58) Field of Classification Search

CPC ..... H01R 43/10; H01R 39/64; H01R 39/29
USPC ..... 439/30
See application file for complete search history.

(56) References Cited

U.S. PATENT DOCUMENTS

| | | | | |
|---|---|---|---|---|
| 2,416,706 | A * | 3/1947 | McLaughlin | A61F 13/2085 28/118 |
| 2,999,991 | A * | 9/1961 | Bender | H01C 10/363 338/162 |
| 3,294,929 | A * | 12/1966 | Johnson | H01H 1/16 200/11 J |
| 4,188,100 | A * | 2/1980 | Prichett | G03B 21/00 353/46 |
| 2008/0042513 | A1* | 2/2008 | Kuenzel | H02K 5/145 310/247 |
| 2014/0038432 | A1 | 2/2014 | Holzapfel et al. | |
| 2014/0099800 | A1 | 4/2014 | Ott et al. | |

FOREIGN PATENT DOCUMENTS

| | | | |
|---|---|---|---|
| DE | 10 2011 006 820 | A1 | 10/2012 |
| DE | 10 2011 077 358 | B3 | 12/2012 |
| EP | 2 451 028 | A2 | 5/2012 |

* cited by examiner

*Primary Examiner* — Jean F Duverne
(74) *Attorney, Agent, or Firm* — Fitch, Even, Tabin and Flannery LLP

(57) ABSTRACT

The invention is a sliding contact and also a method for the production thereof. The sliding contact arrangement has two parts mounted to rotate relatively to one another. The first part has a metallic carrier ring with radial inner and outer sides, which is monolithically connected to at least one spring arm, which ends freely on one side on the inner side or outer side. The spring arm extends longitudinally relative to the inner or outer side at least in certain sections. The spring arm ends at a spring arm head having a contact surface facing away from the carrier ring, which is in sliding contact with a contact surface of the second part.

39 Claims, 3 Drawing Sheets state of the art state of the art

SLIDING CONTACT ARRANGEMENT FOR TRANSMITTING ELECTRICAL SIGNALS AND ALSO A METHOD FOR PRODUCING THE SLIDING CONTACT ARRANGEMENT

BACKGROUND OF THE INVENTION

1. Field of the Invention

The invention relates to an electrical sliding contact arrangement and also to a method for producing the sliding contact arrangement.

Electrical sliding contact arrangements are used for transmitting electrical signals and/or electrical energy between two components mounted such that they can be moved relatively to one another. In addition to known sliding contact arrangements with linear or curved sliding paths, the present invention relates to the an electrical rotary coupling with an integrated slip ring arrangement, which essentially has two electrically conductive parts, which are mounted such they can rotate relatively to one another, concentrically about a common rotational axis, and of which one part is connected to a rotating component of the rotary coupling and the other part is connected to the stationary rotary coupling component.

2. Description of the Prior Art

A generic, compactly structured electrical rotary coupling is described in EP 2 451 028 A2, which provides an axial stack, having a multiplicity of electrically conductive slip rings of annular or disc-shaped construction, along a rotatable shaft in which the slip rings are each axially separated from one another by electrically insulating intermediate discs. Each of the slip rings is connected to an electrical signal line along the rotating shaft and thus forms an electrical transmission channel. In accordance with the number of slip rings, securely clamped brush wires are attached on one side of the stationary housing part of the rotary coupling, which individually come into tangential sliding contact with the sliding paths, which peripherally surround the slip rings. In the same way as the slip rings, the individual stationary brush wires are each respectively connected to an electrical supply and ground.

A slip ring arrangement is described in DE 10 2011 006 820 A1, which is used for electrically connecting two parts that can be rotated with respect to each other and has at least one sliding path with V grooves. At least two wire brushes run into the sliding paths, wherein the wire brushes are electrically connected to one another and arranged on different brush blocks.

DE 10 2011 077 358 B3 discloses a similar brush block arrangement for a rotationally-symmetrically constructed sliding path of the rotary coupling, in which two brushes constructed in a pin-shaped manner are in each case securely fastened on one side on different brush supports and in each case enter into tangentially sliding engagement with the sliding path.

Known electrical sliding contact arrangements, which are integrated into rotary couplings, are for the most part based on the structural combination as illustrated in FIG. 4 of a slip ring 1 rotating about a rotational axis, at the circumferential edge of which slip ring, at least one sliding path 2 is constructed, upon which sliding bodies 3 for transmitting electrical signals or electrical energy are pressed in a sliding manner and subject to a force. The sliding bodies are for the most part fastened on one side via a spring arm 4 on a brush support 5, which is connected to the stationary housing part of the rotary coupling. The spatially large structure of a sliding contact arrangement of this type, the assembly of which comprises a plurality of individual components is illustrated in FIG. 4.

SUMMARY OF THE INVENTION

The invention is a sliding contact arrangement with two parts that are mounted such that they can be rotated relatively to one another, preferably for integration into a rotary coupling, in such a manner that the electrical sliding contact arrangement is as compact as possible, is small in structure and also has an improved electrical transmission behavior compared to previously known sliding contact arrangements. Furthermore, the production of the sliding contact arrangement should be inexpensive and reliable while always having product quality, particularly in the case of small-scaled sliding contact arrangements.

A sliding contact arrangement according to the invention comprises two parts mounted to be rotatable relative to one another. The first part has a metallic carrier ring with radial inner and outer sides. The outer and/or inner side of the metallic carrier ring is monolithically connected by at least one spring arm, which ends freely on one side. The spring arm longitudinally extends relative to the inner or outer side at least in certain sections. That is in the case of at least one spring arm monolithically connected to the inner side, the same has a spring arm longitudinally extending to be orientated longitudinally relative to the inner side at least in certain sections, which preferably has a spring arm curvature that is adapted to the curvature of the inner side. The same applies for at least one spring arm monolithically connected on the outer side of the carrier ring.

The at least one spring arm has a head located at the free end of the spring arm end, which is monolithically connected to the spring arm and has a contact surface facing away from the carrier ring, which is in sliding contact with a contact surface of the second part of the sliding contact arrangement. The sliding contact arrangement according to the invention therefore stands out on account of the monolithic design of the first part, which in sliding contact arrangements, which are known per se, corresponds to the brush support having brush wires connected thereto and also the sliding bodies attached thereto. Due to the monolithic design, it is not only possible to scale the size of the sliding contact arrangement as desired, thus in particular to miniaturize it. As the further configurations will show, it is furthermore possible to make the production of the monolithic first part of the sliding contact arrangement in particular highly precise and cost effective.

A first preferred embodiment of the sliding contact arrangement provides a first part radially encompassing the second part, on its radial inner side. The carrier ring of the first part has at least one spring arm monolithically connected to the same. The spring arm head slides on the radially outer contact surface of the second part, which is preferably of annular or disc-shaped construction. The second part is a rotating slip ring, which is mounted rotatably about an axis of rotation, to which the carrier ring of the first part is concentrically arranged.

Two or more spring arms are preferably monolithically connected to the carrier ring along the radial inner side of the carrier ring. The spring arms are arranged in as evenly distributed a manner as possible along the inner ring side. In this case, all of the spring arms monolithically attached on the inner side extend with a uniform orientation with the ends (the spring arm heads) of the spring arms pointing uniformly in the clockwise or anti-clockwise direction. All spring arms are identically constructed, have a uniform spring arm length and moreover each have a uniformly shaped spring arm head with a preferably rounded sliding surface. Each individual spring arm which is attached on the inner side of the carrier ring additionally has a uniform spring arm curvature at least in certain sections, which is configured to the curvature of the inner side of the carrier ring or is identical thereto. The spring arms constitute spring beams clamped on one side, which have a radially orientated spring stiffness and deflectability, which can be predetermined individually by the choice of the spring arm length, spring arm geometry and also the material from which the carrier ring, including spring arms is made. Preferably, all the spring arms which are monolithically connected to the carrier ring are identically constructed, so that the spring arm heads of the individual spring arms are in a force-free state, such that the spring arm heads do not bear in a spring-loaded manner on the contact surface of the second part and are disposed on a virtual circle running concentrically to the carrier ring.

The second part of the sliding contact arrangement has a contact surface constructed in a circular manner with a diameter, that may be the same, but is preferably chosen to be larger than the diameter of the virtual circle, which is predetermined by the position of the spring arm heads. Resulting from the concentric mounting of the second part relative to the first part, the contact surfaces of the multiplicity of spring arm heads are spring loaded to bear by contact surfaces and to slide against the contact surface of the second part.

Advantageously, the contact surfaces of the individual spring arm heads are constructed in a rounded manner so that a bidirectional relative movement between first and second part is possible, without the contact surfaces of the spring arm heads having a tendency to catch the opposite contact surface of the second part.

In order to improve the sliding and/or contact properties, one embodiment provides for the construction of the spring arm heads to be coated with a highly electrically conductive material, for example with gold, nickel, etc., to construct the contact surface.

A further embodiment of a sliding contact arrangement according to the invention provides for an annularly constructed second part, which at least has a metallic ring inner side, corresponding to the contact surface of a rotating slip ring. The first part of the sliding contact arrangement by contrast has a metallic carrier ring with at least one spring arm attached on the ring outer side but preferably multiple spring arms arranged to be evenly distributed along the ring outer side. The spring arms are monolithically connected to the carrier ring. The spring arm heads of the individual spring arms are arranged, in the same manner as described in the previous example, along a virtual circle. The diameter of the virtual circle is dimensioned larger than the diameter of the circular contact surface of the second part, which radially encompasses the first part. In this way, the spring arm heads reach radially outwardly in a spring-loaded manner onto the contact surface of the annularly constructed second part.

Due to the completely monolithic configuration of the first part, including having the carrier ring and the spring arms attached thereon, including spring arm heads, a possibility exists for a very precise production method, which is very cost-effective in terms of process engineering. The production method relates back to the methods of electrical discharge machining, spark erosion, laser-beam cutting or water-jet cutting.

A metallic sheet or plate like surface piece is used as a starting point, for example a brass alloy, copper beryllium or high-grade steel may be used, which can have a sheet or plate thickness in the tenth-of-a-millimeter range to two- to three-figure millimeter range. On the basis of information defining the shape and size of the geometric configuration of the first part, for example in the form of CAD information, the surface piece is machined with one of the preceding separation methods, in which the complete final shape of the first part, comprising the carrier ring and also the spring arms monolithically attached along the inner and/or outer side of the carrier ring, including spring arm heads, can be obtained by separation from the machined surface piece. The second part of the sliding contact arrangement can be obtained in the same way with the separation method mentioned, from metallic sheet- or plate-like surface pieces or can be created in some other manner. Finally, the sliding contact arrangement may have both parts arranged such they can rotate relatively to one another, concentrically about a common axis, preferably in the context of an electrical rotary coupling.

In order to improve the economic efficiency of the production method, it therefore makes sense to provide a multiplicity of metallic sheet- or plate-like surface pieces in the form of a sheet stack, which is supplied to one of the previously mentioned separation methods for constructing at least the first part in each case.

In view of the above-described separation methods, any post-processing steps on the components separated from the surface piece are superfluous. Thus, it is possible to construct even minimally dimensioned structures, as occur in particular in the region of the spring arm head, finely and in a burr-free manner.

BRIEF DESCRIPTION OF THE DRAWINGS

The invention is described by way of example in the following drawings without limiting the invention on the basis of exemplary embodiments with reference to the drawings. In the figures.

DETAILED DESCRIPTION OF THE INVENTION

Figure 1A:
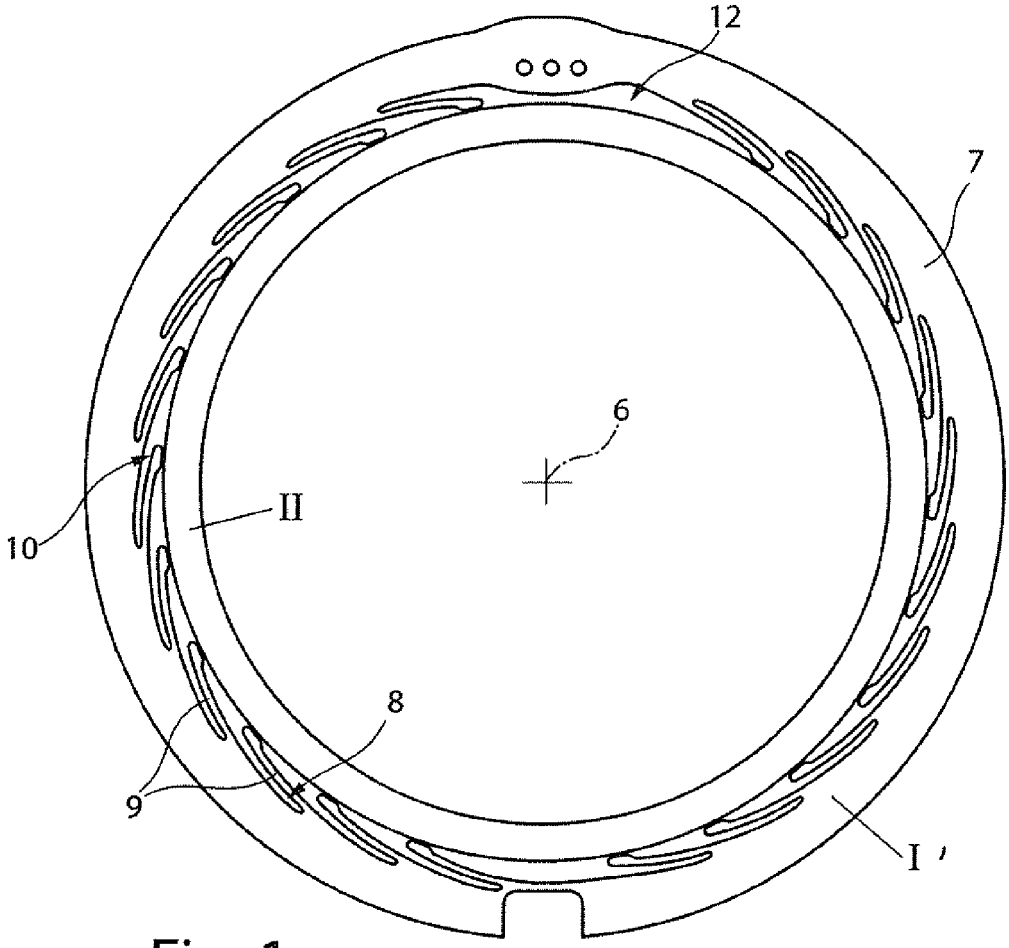
FIGS. 1*a* and *b* illustrate the sliding contact arrangement according to the invention.
Figure 1B:
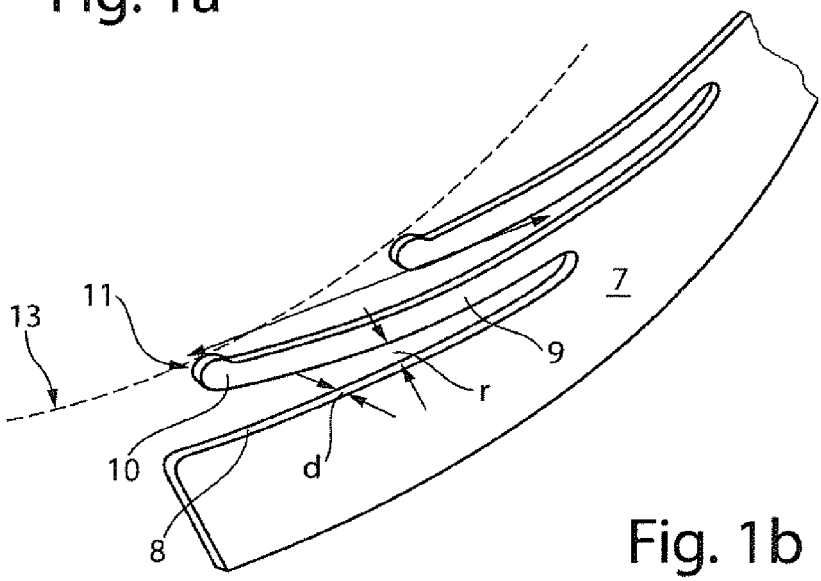

FIG. 1*a* shows a sliding contact arrangement constructed according to the invention, having an annularly constructed second part II, which is arranged radially such that it can rotate coaxially about an axis of rotation 6 located radially inwardly relatively to a first part I and which integrally has a metallic carrier ring 7 and also a multiplicity of spring arms 9 monolithically connected to the carrier ring 7 on the radial inner side 8 thereof. The monolithic design of the first part I can be seen in detail on the basis of the detailed illustration given in FIG. 1*b*.

The first part I is preferably machined from a flat metallic material and has a thickness d, typically of a few tenths of a millimeter up to a two- to three millimeter range. A spark erosion or electrical discharge machining method, and if appropriate also laser cutting or water jet cutting methods, are particularly advantageously suitable for producing the first part. By using these methods, the first part can be produced in an integral design on the basis of a CAD data set or in the manner of a CAM operating method.

Each of the individual spring arms 9 is integrally monolithically connected to the carrier ring 7 at a longitudinal end and has a spring arm head 10 located at the free or loose end thereof, which has a contact surface 11, which is constructed to be burr-free and being bidirectionally curved, so that the contact surface 11 can enter into uniformly sliding engagement with the contact surface of the second part II constructed as a slip ring, for relative movement orientated in a clockwise or anti-clockwise direction between the first and second parts.

Each of the spring arms 9 which is monolithically connected to the carrier ring 7 on the inner side 8 has a central radial spacing r with respect to the inner side 8 of the carrier ring 7, in this manner, the spring arm 9 can be deflected radially bidirectionally and has a spring stiffness dependent on the spring arm length l and also the chosen material of the first part I. The length l of the spring arm 9 is typically chosen to be twice to 30-times as long as the central spacing r.

The number of the spring arms 9 provided along the inner side 8 of the carrier ring 7, the geometry of each individual spring arm and also curvature and relative position of the spring arm with respect to the carrier ring 7 can be suitably chosen, in order to produce a desired electrical contact between both parts I and II. The inner second part II has an electrical contact surface 12 on the external circumference thereof. Preferably, the second part II is also made completely from a metallic material, such as, for example brass or high-grade steel. The external diameter of the second part II, which in the exemplary embodiment illustrated in FIG. 1*a* is of an annular construction, can also be configured as a solid disc, depending on the use and construction. The disc has a diameter which is chosen to be the same or preferably larger than the diameter of a virtual circle 13, along which the individual spring arm heads 10 of the spring arms 9 are arranged in an otherwise force-free state. In this way, it is ensured that in the case of a concentric mutual engagement of the second part II relative to the first part I, all spring arm heads 10 come into sliding contact with the contact surface 12 of the second part II.

Figure 2A:
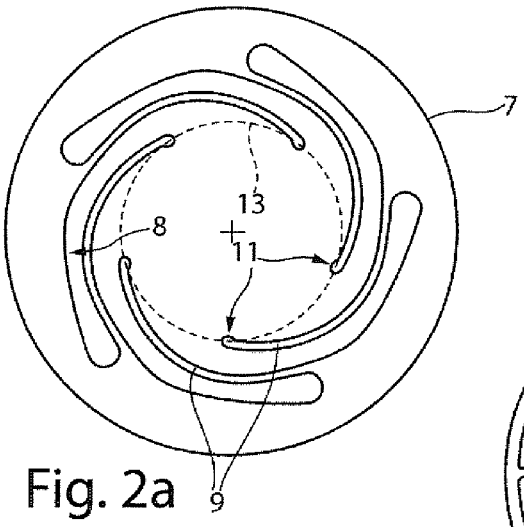
FIGS. 2*a, b, c* and *d* show different exemplary embodiments for the carrier ring having spring arms.
Figure 2B:
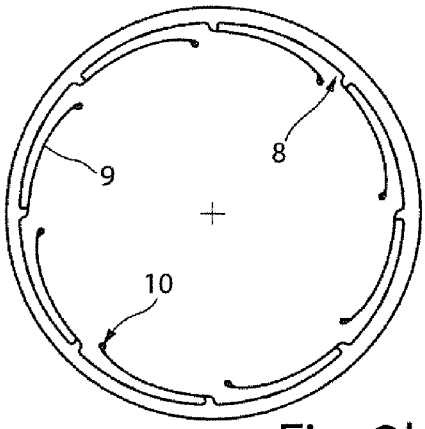
Figure 2C:
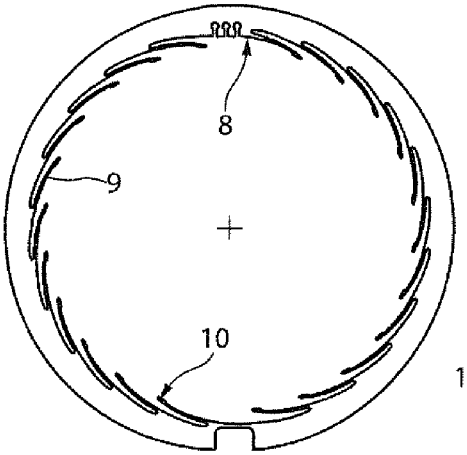

The FIGS. 2*a* to *d* show different embodiments for the configuration of the first part I. FIG. 2*a* shows a carrier ring 7, which along the inner side 8, spring arms 9 are provided. In each case the assigned spring arm heads 11 re arranged along a common virtual circle 13 shown in FIG. 1*b*. In the case of FIG. 2*b*, eight spring arms 9 are monolithically connected to the carrier ring 7. FIG. 2*c* shows the first part I illustrated in FIG. 1 in a detailed view. Common to all embodiments according to the FIGS. 2*a* to 2*c* is the spring arms 9 being attached on the inner side 8 of the carrier ring 7. The spring arm longitudinal extensions are uniformly orientated in the clockwise direction so that the free ends 10 of each individual spring arm 9 assume a uniform relative position with respect to the connections thereof to the carrier ring 7.

Figure 2D:
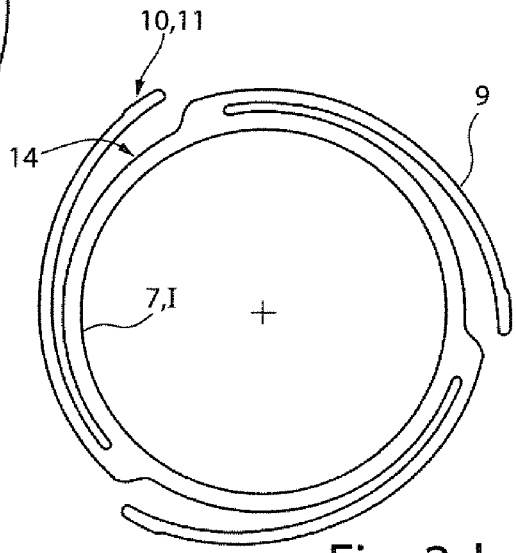

A variant of the first part I, shown in FIG. 2*d*, has the spring arms 9 attached on the outer side 14 of the carrier ring 7. In the illustration, only three spring arms 9 are monolithically connected to the carrier ring 7 in an evenly distributed manner along the circumferential direction. A concentrically arranged second part, which is constructed as a slip ring (not illustrated in any more detail), is used for electrical contact transmission. The second part is radially externally attached to the first part I and the contact surface thereof comes into sliding engagement with the contact surfaces 11 of the three spring arm heads 10.

In all embodiments, it is advantageous to construct the shape of the spring arm heads 10 so that a bidirectional relative movement between the first and second parts is possible, without the spring arm heads 10 catching on the respectively radially opposite contact surface 12 of the second part.

Figure 3:
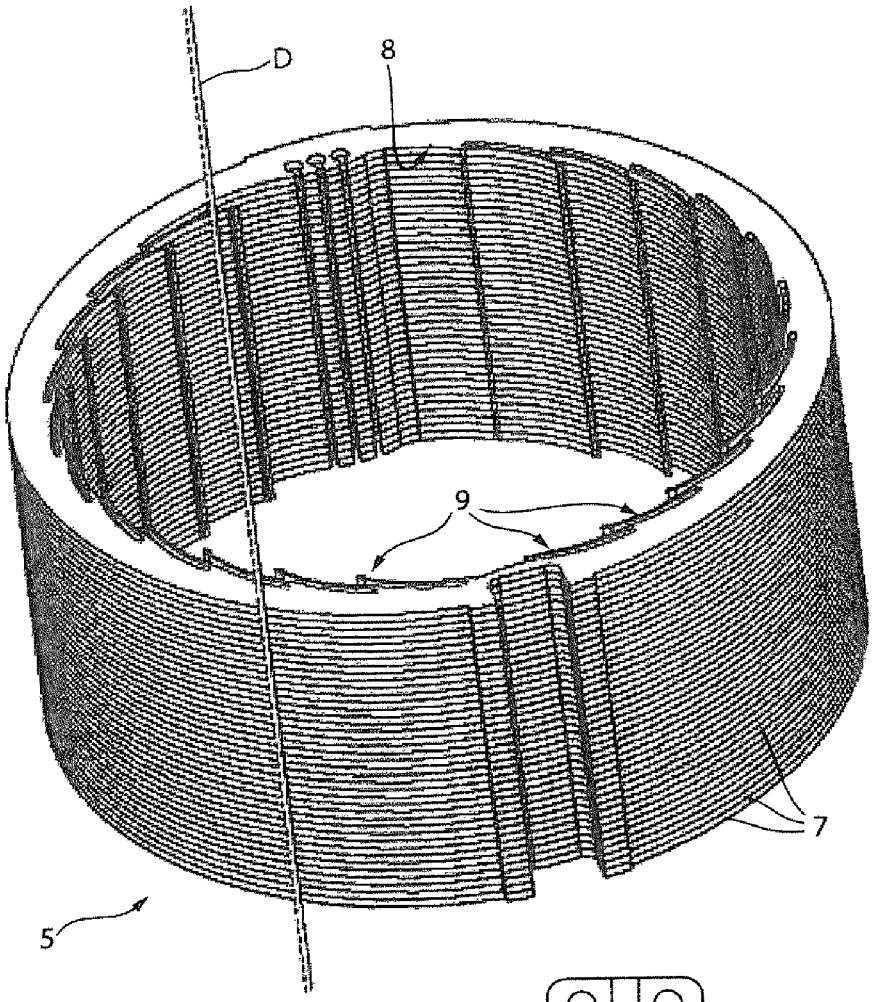
FIG. 3 shows a stack arrangement for producing a multiplicity of carrier rings with spring arms; and also
Figure 4:
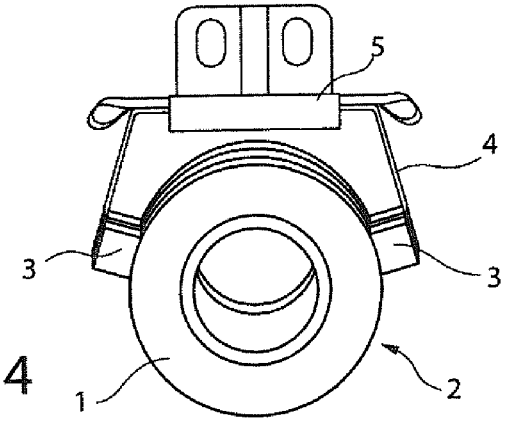
FIG. 4 shows an illustration of a prior art sliding contact arrangement.

FIG. 3 shows a perspective illustration of a stack arrangement s consisting of a multiplicity of carrier rings 7 each produced from metallic flat material, with spring arms 9 being attached on the inner side 8 thereof. The spring arms have been produced by an electrical discharge machining method from a solid flat material in a stacked arrangement. To this end, a wire D comes into cutting contact with the surface piece stack 5 and has a tendency, by following the corresponding contours, to separate the respectively first parts I from the surface piece stack in a burr-free manner.

With the use of an electrical discharge machining or spark erosion method, a cost-effective and also precise production of the carrier ring having the spring arms can be achieved in the stack method. The setting of the spring stiffness or the spring characteristic of the individual spring arms can be chosen individually by the choice of the geometry and also the choice of the material from which the carrier ring is manufactured. Additionally, the separation methods allow a burr-free construction of the individual spring arms, which are monolithically connected to the carrier ring. Therefore, a post-processing of the sliding surfaces provided on the spring arm heads is not necessary.

The sliding contact arrangement according to the invention enables a compact design for producing a rotary coupling, used for the transmission of electrical signals and/or electrical energy between two components arranged such that they can rotate relatively to one another. In particular, a sliding contact arrangement constructed according to the invention has a substantially smaller installation space than conventional sliding contact arrangements. Also, the simple production by method technology based on CAD data, which contain the geometric construction of the first part, allows virtually any desired scaling of the respectively first part, so that sliding contact arrangements with diameter dimensions of less than one centimeter can be achieved.

REFERENCE LIST

1 Inner race
2 Contact surface
3 Sliding body
4 Spring arm
5 Brush block arrangement
6 Axis of rotation
7 Carrier ring
8 Inner side
9 Spring arm
10 Spring arm head
11 Contact surface
12 Contact surface
13 Virtual circle
14 Carrier ring outer side
I First part
II Second part
R Central radial spacing
d Carrier ring thickness
D Wire

The invention claimed is:

1. A sliding electrical contact comprising two electrically conductive first and second parts mounted to rotate relative to one another, the first part including a metallic carrier ring with a radial inner side and a radial outer side, the first part being monolithically connected to at least one spring arm, the at least one spring arm having an end including a head, the at least one spring arm being movable radially at the end relative to the first part, extending either from the radial inner side or extending from the radial outer side at least at some locations on the metallic carrier ring, and the head having a contact surface facing away from the carrier ring which slides in contact with a contact surface of the second part.

2. The sliding contact according to claim 1, wherein:
the carrier ring, the at least one spring arm and the spring arm head of the first part are monolithical.

3. The sliding contact according to claim 1, wherein:
the at least one spring arm is longer in length than an average radial spacing between the at least one spring arm along the inner side or the outer side and the carrier ring.

4. The sliding contact according to claim 3, wherein:
the at least one spring arm is longer in length than an average radial spacing between the at least one spring arm along the inner side or the outer side and the carrier ring.

5. The sliding contact according to claim 3, wherein:
the spring arm length ranges from about 2 to 30 times the average radial spacing.

6. The sliding contact according to claim 5, wherein:
the spring arm length ranges from about 2 to 15 times the average radial spacing.

7. The sliding contact according to claim 4, wherein:
the spring arm length ranges from about 2 to 30 times as the average radial spacing.

8. The sliding contact according to claim 7, wherein:
the spring arm length ranges from about 2 to 15 times the average radial spacing.

9. The sliding contact according to claim 1, comprising:
at least two spring arms evenly distributed along a circumference of the carrier ring and facing the radial inner side or the radial outer side of the carrier ring and the spring arms have an identical orientation relative to the carrier ring.

10. The sliding contact according to claim 2, comprising:
at least two spring arms evenly distributed along a circumference of the carrier ring and facing the radial inner side or the radial outer side of the carrier ring and the spring arms have an identical orientation relative to the carrier ring.

11. The sliding contact according to claim 3, comprising:
at least two spring arms evenly distributed along a circumference of the carrier ring and facing the radial inner side or the radial outer side of the carrier ring and the spring arms have an identical orientation relative to the carrier ring.

12. The sliding contact according to claim 4, comprising:
at least two spring arms evenly distributed along a circumference of the carrier ring and facing the radial inner side or the radial outer side of the carrier ring and the spring arms have an identical orientation relative to the carrier ring.

13. The sliding contact according to claim 5, comprising:
at least two spring arms evenly distributed along a circumference of the carrier ring and facing the radial inner side or the radial outer side of the carrier ring and the spring arms have an identical orientation relative to the carrier ring.

14. The sliding contact according to claim 6, comprising:
at least two spring arms evenly distributed along a circumference of the carrier ring and facing the radial inner side or the radial outer side of the carrier ring and the spring arms have an identical orientation relative to the carrier ring.

15. The sliding contact according to claim 7, comprising:
at least two spring arms evenly distributed along a circumference of the carrier ring and facing the radial inner side or the radial outer side of the carrier ring and the spring arms have an identical orientation relative to the carrier ring.

16. The sliding contact according to claim 8, comprising:
at least two spring arms evenly distributed along a circumference of the carrier ring and facing the radial inner side or the radial outer side of the carrier ring and the spring arms have an identical orientation relative to the carrier ring.

17. The sliding contact according to claim 1, wherein:
the carrier ring has a thickness orientated transverse to a plane defined by the carrier ring; and
the at least one spring arm has a thickness corresponding to a thickness of the carrier ring.

18. The sliding contact according to claim 2, wherein:
the carrier ring has a thickness orientated transverse to a plane defined by the carrier ring; and
the at least one spring arm has a thickness corresponding to a thickness of the carrier ring.

19. The sliding contact according to claim 3, wherein:
the carrier ring has a thickness orientated transverse to a plane defined by the carrier ring; and
the at least one spring arm has a thickness corresponding to a thickness of the carrier ring.

20. The sliding contact according to claim 5, wherein:
the carrier ring has a thickness orientated transverse to a plane defined by the carrier ring; and
the at least one spring arm has a thickness corresponding to a thickness of the carrier ring.

21. The sliding contact according to claim 9, wherein:
the carrier ring has a thickness orientated transverse to a plane defined by the carrier ring; and
the at least one spring arm has a thickness corresponding to a thickness of the carrier ring.

22. The sliding contact according to claim 1, wherein:
the contact surface has a rounded contour which guides the head to slide bidirectionally relative to the contact surface of the second part.

23. The sliding contact according to claim 2, wherein:
the contact surface has a rounded contour which guides the head to slide bidirectionally relative to the contact surface of the second part.

24. The sliding contact according to claim 3, wherein:
the contact surface has a rounded contour which guides the head to slide bidirectionally relative to the contact surface of the second part.

25. The sliding contact according to claim 5, wherein:
the contact surface has a rounded contour which guides the head to slide bidirectionally relative to the contact surface of the second part.

26. The sliding contact according to claim 9, wherein:
the contact surface has a rounded contour which guides the head to slide bidirectionally relative to the contact surface of the second part.

27. The sliding contact according to claim 17, wherein:
the contact surface has a rounded contour which guides the head to slide bidirectionally relative to the contact surface of the second part.

28. The sliding contact according to claim 1, wherein:
the at least one spring arm is curved along a longitudinal dimension thereof and at least some part thereof corresponds in shape to the radial inner side or the radial outer side of the carrier ring.

29. The sliding contact according to claim 2, wherein:
the at least one spring arm is curved along a longitudinal dimension thereof and at least some part thereof corresponds in shape to the radial inner side or the radial outer side of the carrier ring.

30. The sliding contact according to claim 3, wherein:

the at least one spring arm is curved along a longitudinal dimension thereof and at least some part thereof corresponds in shape to the radial inner side or the radial outer side of the carrier ring.

31. The sliding contact according to claim 5, wherein:

the at least one spring arm is curved along a longitudinal dimension thereof and at least some part thereof corresponds in shape to the radial inner side or the radial outer side of the carrier ring.

32. The sliding contact according to claim 9, wherein:

the at least one spring arm is curved along a longitudinal dimension thereof and at least some part thereof corresponds in shape to the radial inner side or the radial outer side of the carrier ring.

33. The sliding contact according to claim 17, wherein:

the at least one spring arm is curved along a longitudinal dimension thereof and at least some part thereof corresponds in shape to the radial inner side or the radial outer side of the carrier ring.

34. The sliding contact according to claim 22, wherein:

the at least one spring arm is curved along a longitudinal dimension thereof and at least some part thereof corresponds in shape to the radial inner side or the radial outer side of the carrier ring.

35. The sliding contact according to claim 1, wherein:

the contact surface of the at least one spring arm is disposed on a virtual circle which, in an absence of an external force and without contact to the second part and has a first diameter;

the contact surface of the second part is rotationally symmetrically formed and has a second diameter; and the first diameter and the second diameter are such that the contact surface of the at least one spring arm bears in a spring loaded and sliding manner on the contact surface of the second part.

36. The sliding contact arrangement according to claim 1, wherein:

the second part is annular and comprises at least one of a metallic ring inner side and a metallic ring outer side;

the first part and the second parts are concentric about a common spatial axis about which at least one part of the two parts is mounted to rotate; and the ring outer side thereof slides in contact with the contact surface of the at least one spring arm which is attached to a radial inner side of the carrier ring of the first part, or the ring inner side of the second part comes slides in contact with the contact surface of the at least one spring arm, which is attached to the radial outer side.

37. The sliding contact of claim 1 comprising:

a two-part rotary coupling for an electrical signal or energy transmission between two components which rotate relative to one and another and wherein;

the one component comprises at least the first part and the other component comprises at least the second part.

38. A method for producing a sliding electrical contact comprising two electrically conductive first and second parts mounted to rotate relative to one another, the first part including a metallic carrier ring with a radial inner side and a radial outer side, the first part being monolithically connected to at least one spring arm, the at least one spring arm having an end including a head, the at least one spring arm being movable radially at the end relation to the first part, extending either from the radial inner side or extending from the radial outer side at least at some locations on the metallic carrier ring and the head having a contact surface facing away from the carrier ring which slides in contact with a contact surface of the second part, the method comprising:

providing a metallic sheet or metallic plate;

processing the sheet or plate based on shape and size information for geometrically configuring the first part by a separation method comprising one of an electrical discharge machining, spark erosion, laser cutting, and water jet cutting;

separating the first part from the processed sheet or plate;

providing the second part; and joining the first part and the second part about a common axis of rotation.

39. The method according to claim 38, comprising:

providing a stack of metallic sheets or plates; and processing the stack of metallic sheets or plates by a separation method.

* * * * *